US008800232B1

(12) United States Patent
Keenan

(10) Patent No.: US 8,800,232 B1
(45) Date of Patent: Aug. 12, 2014

(54) FLANGE SHEAR CONNECTION FOR PRECAST CONCRETE STRUCTURES

(75) Inventor: Lawrence E. Keenan, Cheshire, CT (US)

(73) Assignee: LEK Innovations, LLC, Hamden, CT (US)

( * ) Notice: Subject to any disclaimer, the term of this patent is extended or adjusted under 35 U.S.C. 154(b) by 416 days.

(21) Appl. No.: 13/079,405

(22) Filed: Apr. 4, 2011

(51) Int. Cl.
*E04B 1/38* (2006.01)
*E04B 1/41* (2006.01)

(52) U.S. Cl.
USPC ..... 52/582.1; 52/125.4; 52/583.1; 52/655.1; 52/698; 52/745.21; 52/253; 14/74.5; 14/75; 14/77.3

(58) Field of Classification Search
USPC ..... 52/125.4, 223.7, 236.8, 250, 252, 258, 52/259, 283, 396.04, 396.06, 582.1, 583.1, 52/699, 703, 251, 253, 655.1, 656.1, 52/656.9, 698, 745.21; 14/74.5, 75, 77.3; 403/68, 69, 70, 71, 75, 110, 187, 188, 403/189, 256, 258, 260, 335, 336, 337, 338
See application file for complete search history.

(56) References Cited

U.S. PATENT DOCUMENTS 736,718 A * 8/1903 Grimm ..... 52/223.13
1,031,926 A * 7/1912 Hansbrough ..... 52/259
1,880,725 A * 10/1932 Bleck ..... 404/48
1,922,945 A * 8/1933 Gravert ..... 52/27
3,122,223 A * 2/1964 Chell et al. ..... 52/295
3,339,750 A * 9/1967 Nelson-Hawkins ..... 211/191
3,342,005 A * 9/1967 Rickards et al. ..... 52/702
3,438,663 A * 4/1969 Colson ..... 403/230
3,513,610 A * 5/1970 Devonport ..... 52/283
3,712,010 A * 1/1973 Porter et al. ..... 52/223.6
3,724,157 A * 4/1973 Miram ..... 52/745.03
3,938,297 A * 2/1976 Sato et al. ..... 403/188
4,014,089 A * 3/1977 Sato et al. ..... 29/525.11
4,035,093 A * 7/1977 Redshaw ..... 403/4
4,094,111 A * 6/1978 Creegan ..... 52/167.4
4,095,912 A * 6/1978 Hagberg ..... 403/187
4,211,400 A * 7/1980 Ray ..... 472/116
4,220,419 A * 9/1980 Hawes ..... 403/189
4,270,748 A * 6/1981 Ray ..... 472/116
4,302,915 A * 12/1981 Stocks ..... 52/175
4,329,826 A * 5/1982 Flogaus et al. ..... 52/712
4,503,652 A * 3/1985 Turner ..... 52/657
4,694,629 A * 9/1987 Azimi ..... 52/611
4,781,006 A * 11/1988 Haynes ..... 52/583.1
4,930,677 A * 6/1990 Jolliffee ..... 228/120
5,061,111 A * 10/1991 Hosokawa ..... 403/232.1
5,154,536 A * 10/1992 Ciudaj ..... 404/118

(Continued)

*Primary Examiner* — Basil Katcheves
*Assistant Examiner* — Rodney Mintz
(74) *Attorney, Agent, or Firm* — DeLio, Peterson & Curcio, LLC; Thomas E. Ciesco

(57) ABSTRACT

A flange connection system for a concrete structure comprising a plurality of adjacent precast concrete members including a platform having a center panel and a first and second flange extending outward from the center panel in opposing directions. The system includes a first and second bent plate each having a horizontal member attached to the bottom surface of the adjacent flanges and a vertical member perpendicular to the horizontal member. The system includes a spacer plate extending in a vertical direction from about a lower edge of the first vertical member to below the first horizontal member and secured between the vertical members of the first and second bent plate with a plurality of fasteners. The first and second vertical member may flex at an upper portion allowing adjacent flange ends to move relative to one another.

10 Claims, 7 Drawing Sheets

(56) References Cited

U.S. PATENT DOCUMENTS

| | | | | |
|---|---|---|---|---|
| 5,197,255 | A * | 3/1993 | Fricker | 52/703 |
| 5,242,239 | A * | 9/1993 | Hosokawa | 403/258 |
| 5,342,138 | A * | 8/1994 | Saito et al. | 403/189 |
| 5,548,939 | A * | 8/1996 | Carmical | 52/707 |
| 5,632,567 | A * | 5/1997 | Lowe et al. | 403/3 |
| 5,660,017 | A * | 8/1997 | Houghton | 52/655.1 |
| 5,671,572 | A * | 9/1997 | Siller-Franco | 52/223.8 |
| 5,904,439 | A * | 5/1999 | Devlin | 403/291 |
| 6,023,899 | A * | 2/2000 | Mecozzi | 52/396.04 |
| 6,073,405 | A * | 6/2000 | Kasai et al. | 52/283 |
| 6,192,645 | B1 * | 2/2001 | Benz et al. | 52/656.1 |
| 6,238,131 | B1 * | 5/2001 | Watts et al. | 403/337 |
| 6,474,902 | B1 * | 11/2002 | Beauvoir | 403/403 |
| 6,488,437 | B1 * | 12/2002 | Jensen | 403/283 |
| 6,584,738 | B1 * | 7/2003 | Andra et al. | 52/223.14 |
| 6,857,156 | B1 * | 2/2005 | Grossman | 14/73 |
| 7,104,024 | B1 * | 9/2006 | diGirolamo et al. | 52/710 |
| 7,174,690 | B2 * | 2/2007 | Zadeh | 52/715 |
| 7,251,918 | B2 * | 8/2007 | Reif et al. | 52/714 |
| 7,627,921 | B2 * | 12/2009 | Azizinamini | 14/74.5 |
| 7,690,500 | B2 * | 4/2010 | Coers et al. | 198/844.2 |
| 7,874,120 | B2 * | 1/2011 | Ohata et al. | 52/655.1 |
| 7,975,439 | B1 * | 7/2011 | Cude | 52/192 |
| 8,161,707 | B2 * | 4/2012 | Simmons | 52/648.1 |
| 8,468,766 | B1 * | 6/2013 | Keenan | 52/583.1 |
| 8,607,515 | B2 * | 12/2013 | Jarvis | 52/253 |
| 8,689,383 | B2 * | 4/2014 | Han | 14/74.5 |
| 2002/0078652 | A1 * | 6/2002 | Hawkes | 52/578 |
| 2006/0144006 | A1 * | 7/2006 | Suzuki et al. | 52/655.1 |
| 2006/0265819 | A1 * | 11/2006 | Azizinamini | 14/74.5 |
| 2007/0261356 | A1 * | 11/2007 | Vaughn | 52/655.1 |
| 2009/0223166 | A1 * | 9/2009 | Ohata et al. | 52/699 |
| 2011/0088347 | A1 * | 4/2011 | Michiels | 52/604 |
| 2011/0107711 | A1 * | 5/2011 | Foley | 52/655.1 |
| 2011/0138735 | A1 * | 6/2011 | Foley | 52/699 |
| 2011/0191967 | A1 * | 8/2011 | Tokuno et al. | 14/74.5 |
| 2011/0243644 | A1 * | 10/2011 | Jarvis | 403/25 |
| 2013/0139466 | A1 * | 6/2013 | Abdel-Rahman et al. | 52/655.1 |
| 2013/0205518 | A1 * | 8/2013 | Han | 14/74.5 |
| 2013/0263392 | A1 * | 10/2013 | Han | 14/74.5 |
| 2014/0020321 | A1 * | 1/2014 | Eklund et al. | 52/582.1 |
| 2014/0083042 | A1 * | 3/2014 | Hiragaki | 52/655.1 |

* cited by examiner

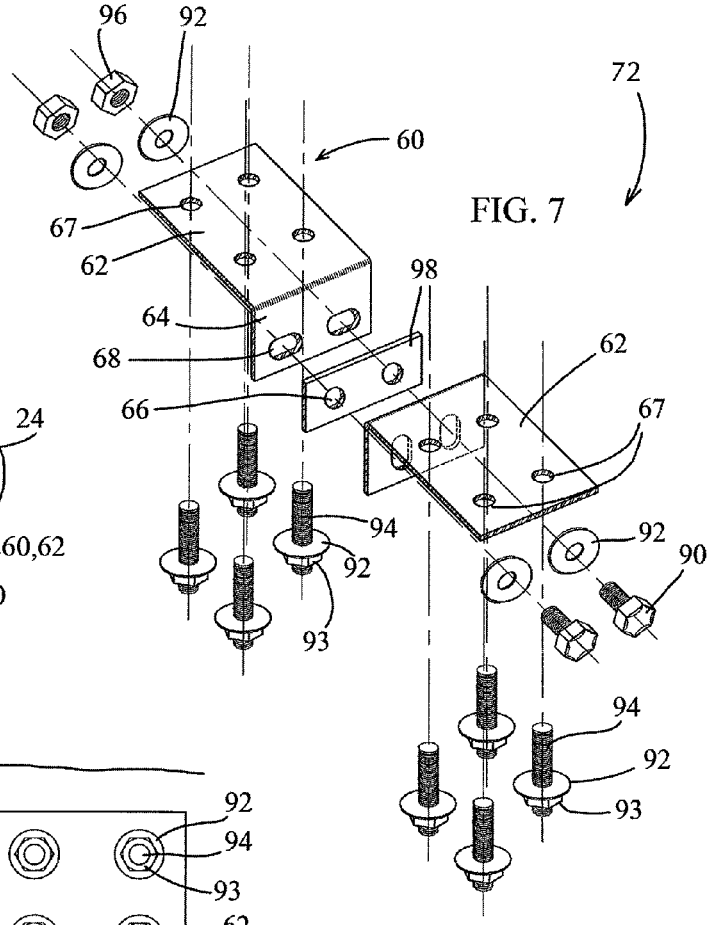
FIG. 7
FIG. 8
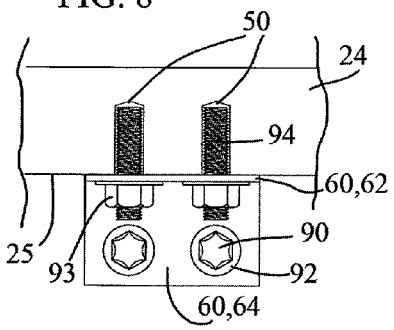
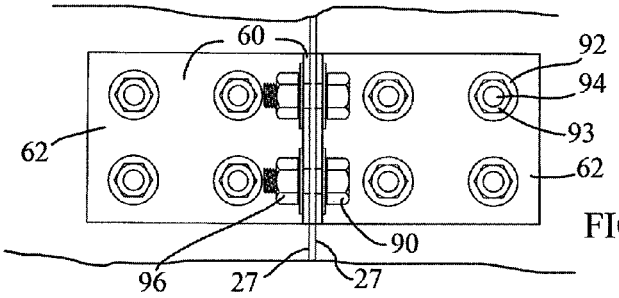
FIG. 9
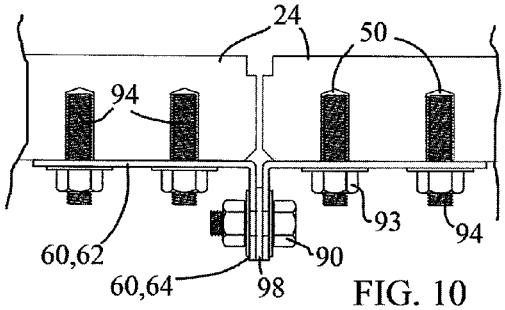
FIG. 10
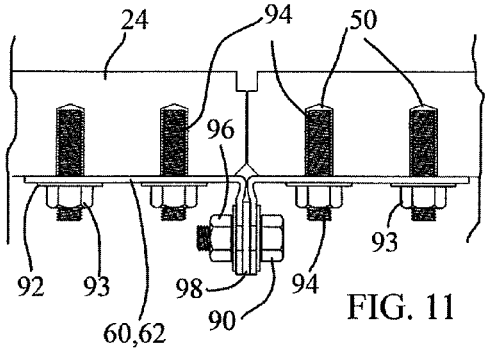
FIG. 11

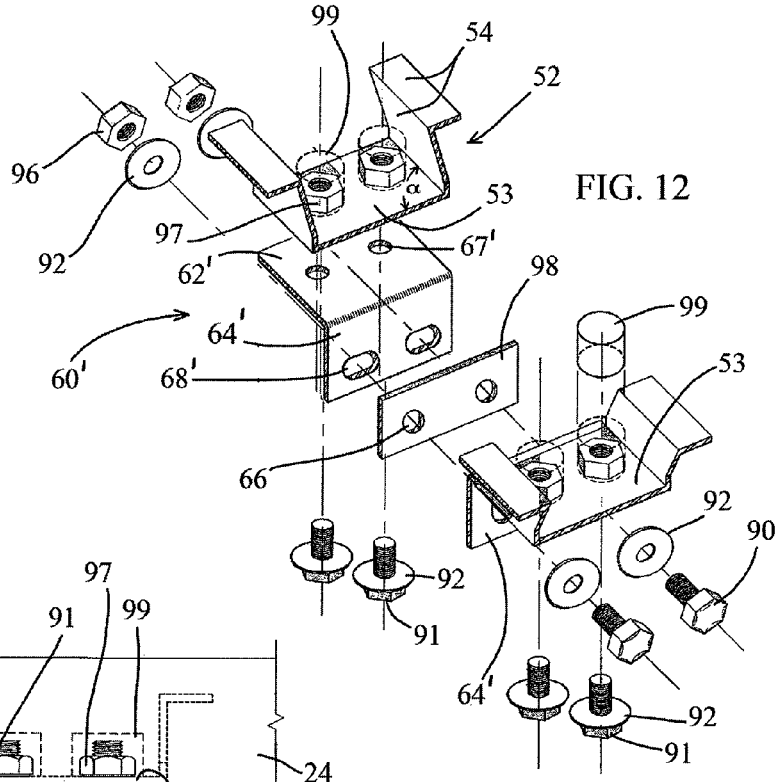
FIG. 12
FIG. 13
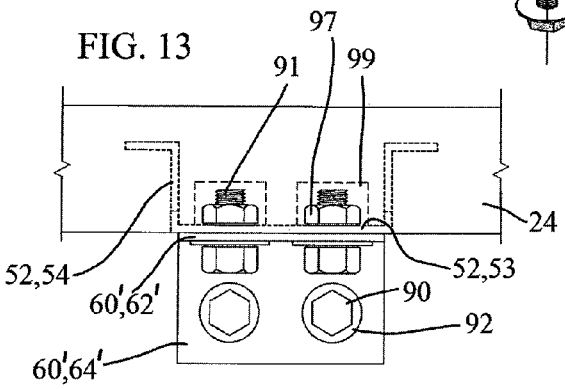
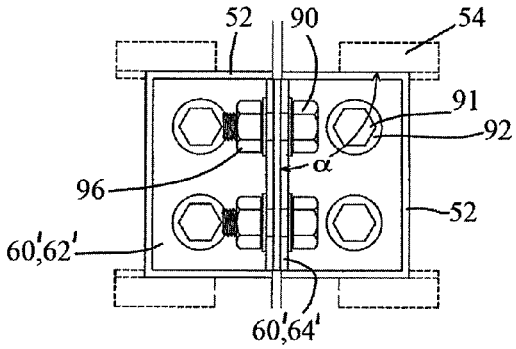
FIG. 14
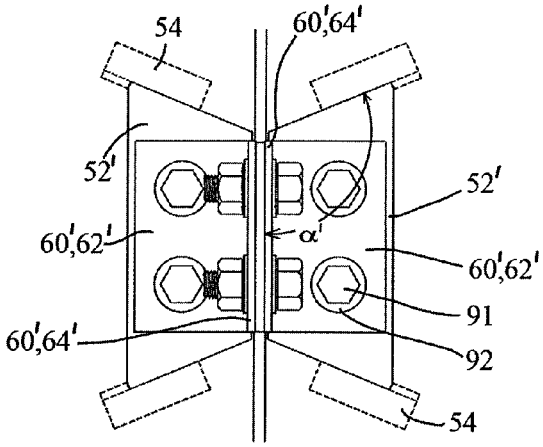
FIG. 15

FLANGE SHEAR CONNECTION FOR PRECAST CONCRETE STRUCTURES

BACKGROUND OF THE INVENTION

1. Field of the Invention

The present invention relates to the creation, replacement, restoration or reinforcement of concrete structure connections.

2. Description of Related Art

Precast, prestressed concrete parking garages have become one of the most popular methods for parking garage construction. This construction consists of fabrication of discrete precast concrete elements or members that are transported to the construction site, lifted into position and connected together.

As shown in a prior art drawing of FIGS. 1 and 2, precast concrete structures typically consist of "tee" or "double tee" beams 26, girders 34, columns 32 and lateral bracing members 30. A lateral bracing member 30 may be a shear wall, brace or frame. The tee/double tee beams are connected together to form the floor/deck. The deck supports gravity loads from vehicles and may be formed from one or more diaphragms. Diaphragms are, in effect, large horizontal beams that transmit lateral loads from seismic and wind events to points of lateral support, typically lateral bracing members 30. The diaphragm may be composed of one or more rows of precast concrete members 26. To form the deck the tee beams are connected to one another with two types of connections, shear connections and chord connections. Tension, compression, vertical shear and horizontal shear are each addressed with connections to resist the respective force or load. Shear connections 56 provide mutual support to gravity (wheel) loads while also transmitting shear within the plane of the deck. Chord connections 58 provide mutual support to gravity (wheel) loads and form chords that restrain tension forces due to in-plane bending of the diaphragm in the manner similar to that in which reinforcement steel restrains tension in a concrete beam under bending. FIG. 2 shows welded chords 45 extending from one end of the diaphragm to the opposite end.

An example of the precast member 26 is a double tee beam shown in FIG. 3 and includes a platform having a length L and a width W. The platform consists of a center panel 40 and flanges 24 extending outward from the center panel. The double tee beam 26' includes a pair of beam webs 12 extending below the platform, the beam web having beam web ends 44 and beam web sides 46 extending between the beam web ends 44. The flange 24 includes flange ends 38 substantially parallel to the beam web 12.

Chord connections are typically used in precast concrete structures and are discussed in U.S. patent application Ser. No. 12/569,246 by the inventor of the present invention. U.S. patent application Ser. No. 12/569,246 is hereby incorporated by reference. Chord connections 58 are shown in FIGS. 4A-4C while shear connections 56 may encompass the connections shown in FIGS. 4A-4C as well as FIG. 4D and provide stability from shear forces. Both shear connections and chord connections are typically achieved by placing a loose erection plate 22' or erection bar 22 between adjacent flanges 24 and welding them to steel plates 20, 20' embedded within the precast members. Embedded steel plates 20, 20' are installed during fabrication of the concrete member prior to placement of the concrete in the formwork. Anchorage of the plate within the concrete is typically achieved by welding the plate to a steel bar, stud or rebar 28 prior to fabrication. The steel plates are positioned within the end of the flange 24 such that the face of each plate is exposed on the end of the flange.

Once the tee beam is placed into position during fabrication of the concrete structure, the gap between embedded plates 20 are bridged with a loose erection bar 22' or dowel 22 and welded together. Once welded, this creates a continuous steel chord within the edge of the diaphragm/deck. The chord connections 58 have an upper cavity 90 which may be filled with a sealant and/or grout. Alternatively or in combination, a layer of concrete may be spread across the top of the flange 24 and flange connection. The chord connections 58 form chords 45 which are embedded in the platform of the diaphragm. The steel bar 28, the steel plate 20 and the erection bar or plate 22 make up the chord 45 and typically extends through all of the platforms in the diaphragm.

The shear connection shown in the top plan view of FIG. 4D is a proprietary Vector Connector 41 consisting of a bent plate 25*b* with wings 25*a* embedded in the flange 24, and although it is not attached to rebar, the wings 25*a* provide sufficient anchorage to act as a shear connection. The bent plate 25*b* is welded to the bent plate of the adjacent Vector Connector 41 using an erection plate 22'. The Vector Connector is not sufficient for tension forces and usually supplements the welded chord connections. The Vector Connections are usually spaced between the chord connections 58 which are along or near the outer edges of the diaphragm.

The welded chords 45 shown in FIG. 2 typically include the chord connections 37 and the embedded steel rods 28. After welding the chord connections during fabrication and erection of the concrete structure, the chord connections and the steel rod form a continuous welded chord. The chord connections 58 mostly determine the integrity of the welded continuous chord.

The existing methods of construction produce numerous problems and failures, generally due to poor design, poor fabrication in the shop, poor construction in the field, and in service deterioration. Welds of the type required require special procedures and specially trained welders and welding code provisions do not allow welds to be used in the manner in which they are loaded in this connection. Quality control/inspection of welding in the shop during fabrication and in the field during erection is essential to the performance of this connection. This quality control is difficult and costly to perform during fabrication and erection and in service.

When the embedded plates are welded during erection of the concrete structure, the heat of welding causes expansion of the plates causing cracks to form in the concrete. Road salts deposited at or near the connection then cause deterioration due to corrosion, especially in cold climates where high concentrations of salt is used to reduce or prevent ice formation. Additionally, the cracks in the concrete allow water to enter, creating further concrete deterioration when the water does freeze. To slow the progress of corrosion at these connections, stainless steel is often used, greatly increasing the cost of production both in the material cost and the construction labor since stainless steel is more costly and more difficult to weld. The stainless steel requires special welder qualifications and expands more than carbon steel, increasing cracks due to expansion. In addition, the steel plates 20 are typically stainless steel and are typically welded to carbon steel rebar, causing a galvanic reaction that accelerates deterioration of the connection.

The connections located within the joint between beams disrupt sealant disposed in the connection joint causing leaks to occur at the connection, accelerating their deterioration and creating leaks within the garage.

The Vector Connections 41 have quickly become the norm for creating shear type connections in precast garages. This has had unintended consequences with regard to chord connections. Previously, shear connections were erected the same way as chord connections and aided in carrying tensile stress within the deck due to restraint to thermal volumetric changes. The Vector Connections are very flexible and provide little to no restraint to tension forces. This previously shared load is instead transmitted to the chord connections, increasing the stress on these components and causing them to fracture.

The diaphragm shown in FIG. 5 consists of multiple double tee beams 26. Seismic or wind loading indicated by the arrows forces the diaphragm to arc or bend laterally. These forces create tension between the concrete members 26 in one part of the diaphragm and compression in between the concrete members in another part of the diaphragm. These forces also create shear between the adjacent concrete members 26. As these forces increase, the diaphragm continues to bend laterally.

Since welded connections are inflexible, the flexibility restraint between points of lateral support creates great stress due to volumetric change from thermal variations, causing connections to fracture. There is a need for a shear connector which provides stability of the concrete structure from shear forces during seismic, wheel and wind loading while providing a connection which allows a small amount of flexibility due to tension and compression forces due to volumetric change from thermal variations, preventing damage to the concrete structure.

SUMMARY OF THE INVENTION

Bearing in mind the problems and deficiencies of the prior art, it is therefore an object of the present invention to provide a system for creating, replacing, restoring or reinforcing connections along adjacent flanges of precast concrete members.

It is another object of the present invention to provide a system for efficient low cost creation, replacement, restoration or reinforcement of flange connections in a concrete structure.

It is another object of the present invention to provide a flexible flange connection in a concrete structure which allows deflection of adjacent precast concrete structures at or near the flexible flange connection.

It is another object of the present invention to provide a shear connector which provides stability of a concrete structure from shear forces while providing a connection which allows a small amount of flexibility due to tension and compression forces created by volumetric change from thermal variation.

Still other objects and advantages of the invention will in part be obvious and will in part be apparent from the specification.

The above and other objects, which will be apparent to those skilled in the art, are achieved in the present invention which is directed to a flange connection system for a concrete structure comprising a plurality of adjacent precast concrete members. The precast concrete member includes a platform having a center panel and a first and second flange extending outward from the center panel in opposing directions, each flange having a bottom surface. The first flange of one concrete member is disposed adjacent to the second flange of the adjacent precast concrete member. The flange connection system includes a first bent plate having a horizontal member attached to the bottom surface of the first flange and a vertical member perpendicular to the horizontal member of the first bent plate. The system includes a second bent plate having a horizontal member attached to the bottom surface of the second flange and a vertical member perpendicular to the horizontal member of the second bent plate. The flange connection system also includes a spacer plate disposed between the vertical member of the first bent plate and the vertical member of the second bent plate and a plurality of fasteners securing the vertical member of the first and second bent plate to the spacer plate.

The spacer plate extends in a vertical direction from about a lower edge of the first vertical member to a distance below the first horizontal member sufficient to allow the first and second vertical member to flex at an upper portion of the vertical member, allowing the first and second flange ends to move toward and away from one another. The first bent plate horizontal member may include openings elongated in the horizontal direction and the second bent plate horizontal member may include openings elongated in the vertical position. The precast concrete member may be a tee beam or a double tee beam.

The flange connection system may include a connector bracket having a portion disposed within the concrete of the first or second flange and an exposed horizontal plate adjacent the bottom surface of the corresponding flange. The horizontal plate includes at least one female threaded connector wherein the horizontal member of the first or second bent plate is fastened to the horizontal plate with at least one male threaded fastener engaged with the at least one female threaded connector. The system may include a second connector bracket having a portion disposed within the concrete of the other of the first or second flange.

Another embodiment of the present invention is directed to a flange connection system for a concrete structure comprising a plurality of adjacent precast concrete members which includes a platform having a center panel and a first and second flange extending outward from the center panel in opposing directions. Each flange has a bottom surface, the first flange of one concrete member being disposed adjacent to the second flange of the adjacent precast concrete member. The flange connection system includes a first connector bracket having at least one horizontal member embedded in the first flange end and a vertical member perpendicular to the at least one horizontal member of the first connector bracket. The flange connection system includes a second connector bracket having at least one horizontal member embedded in the second flange end and a vertical member perpendicular to the at least one horizontal member of the second connector bracket. The system includes a first folded plate clip adapted to engage the vertical member of the first connector bracket, a second folded plate clip adapted to engage the vertical member of the second connector bracket and a spacer plate disposed between the first and second folded plate clip. The system includes a plurality of fasteners securing the vertical member of the first and second connector bracket to the spacer plate. The system may include the spacer plate extending in a vertical direction from about a lower edge of the first vertical member to a distance below the first horizontal member sufficient to allow the first and second vertical member to flex at an upper portion of the vertical member, allowing the first and second flange ends to move toward and away from one another. The spacer bar may extend in a vertical direction from about a lower edge of the first vertical member to below the first horizontal member such that when the spacer bar is fastened between the first and second vertical member, the first and second vertical member may flex at an upper portion of the vertical member, allowing the flange ends to move relative to one another. The first bent plate vertical member includes openings elongated in the horizontal direction and the second bent plate vertical member includes openings elongated in the vertical direction. The precast concrete member may be a tee beam or a double tee beam.

Another embodiment of the present invention is directed to a method for installing flange connections for precast concrete structures. The method comprises providing a plurality of adjacent precast concrete members which includes a platform having a center panel and a first and second flange having a flange bottom surface and a flange end, the flanges extending outward from the center panel in opposing directions. The first flange end of one concrete member is disposed adjacent to the second flange end of the adjacent precast concrete member. The method includes providing a first and second bent plate each having a horizontal member attachable to the bottom surface of the first and second flange respectively and a vertical member perpendicular to the horizontal member. The vertical member includes vertical member openings. The method includes providing a spacer plate having spacer plate openings, providing a plurality of fasteners and ensuring the first flange is aligned with the second flange. The method includes fastening the first bent plate to the bottom surface of the first flange, fastening the second bent plate to the bottom surface of the second flange and placing the spacer plate between the first connector bracket vertical member and the second connector bracket vertical member with the spacer plate openings aligning with first connector bracket vertical member openings and the second connector bracket vertical member openings. The method includes placing the fasteners through the openings of the first connector bracket vertical member openings, spacer plate openings and second connector bracket vertical member openings and tightening the fasteners.

The method may include the spacer plate extending in a vertical direction from about a lower edge of the first vertical member to below the first horizontal member such that when the spacer bar is fastened between the first and second vertical member, the first and second vertical member may flex at an upper portion of the vertical member, allowing the flange ends to move relative to one another.

The first bent plate vertical member may include openings elongated in the horizontal direction and the second bent plate vertical member may include openings elongated in the vertical direction. The precast concrete member may be a tee beam or a double tee beam.

Another embodiment of the present invention is directed to a flange connector for the connection of adjacent precast concrete members comprising a plurality of bent plates having a horizontal member for attaching to a bottom surface of the precast concrete member and a vertical member perpendicular to the horizontal member. The flange connector includes a spacer plate for engagement between the vertical members of adjacent bent plates and at least one fastener for securing the vertical members to the spacer plate. The spacer plate may extend in a vertical direction from about a lower edge of the vertical member to below a plane of the horizontal member.

The flange connector may include a gap between a top surface of the spacer plate and the plane of the horizontal member sufficient to allow the vertical member to flex along an upper portion of the vertical member, thereby allowing the adjacent precast concrete members to deflect relative to one another.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 7 is a perspective view of the flexible shear connection according to the present invention.

FIG. 8 is a front elevational view of the flexible shear connection shown in FIG. 7.

FIG. 9 is a bottom plan view of the flexible shear connection shown in FIG. 7.

FIG. 10 is a side elevational view of the flexible shear connection shown in FIG. 7.

FIG. 11 is a side elevational view of the flexible shear connection shown in FIG. 7 with the flexible shear connection in a flexed position due to compression across the joint.

FIG. 12 is a perspective view of a third embodiment of the flexible shear connection according to the present invention.

FIG. 13 is a front elevational view of the flexible shear connection shown in FIG. 12.

FIG. 14 is a bottom plan view of the flexible shear connection shown in FIG. 12.

FIG. 15 is a bottom plan view of the flexible shear connection wherein angle $\alpha$ is an obtuse angle.

DESCRIPTION OF THE PREFERRED EMBODIMENTS

In describing the preferred embodiment of the present invention, reference will be made herein to FIGS. 6-24 of the drawings in which like numerals refer to like features of the invention.

The present invention is an apparatus and a system for creating, replacing, restoring or reinforcing flange connections of adjacent precast concrete structures such as a double tee beam. The system includes providing flexible shear connections along the flanges of adjacent concrete structures. The shear connection is for securing the tee beams from shear forces which shift one beam vertically from the adjacent beam due to gravity loads or longitudinally due to lateral forces such as seismic and wind loads.

Figure 1:
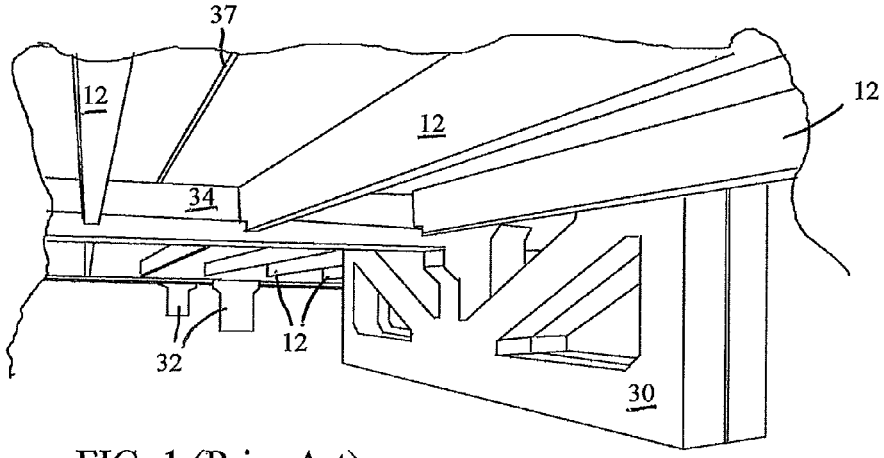
FIG. 1 (Prior Art)
FIG. 1 is a prior art perspective view of a concrete structure.
Figure 2:
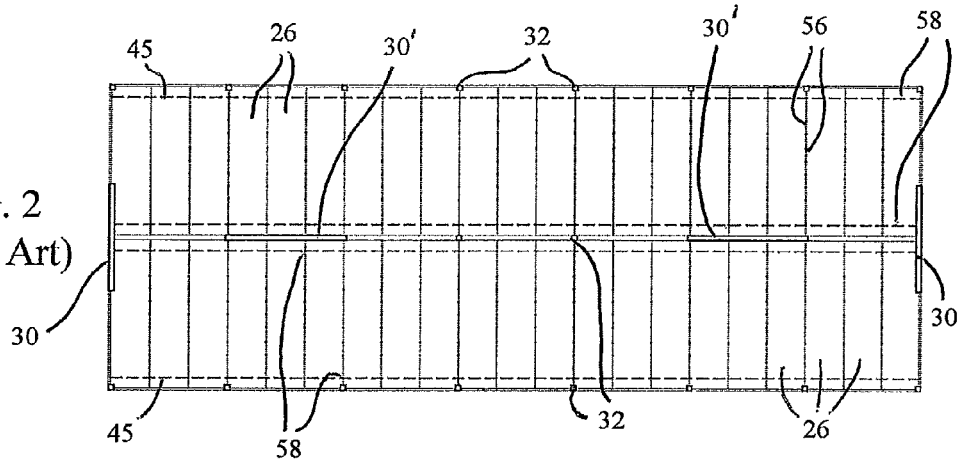
FIG. 2 (Prior Art)
FIG. 2 is a top elevational view of a concrete structure having chord and shear connections.
Figure 3:
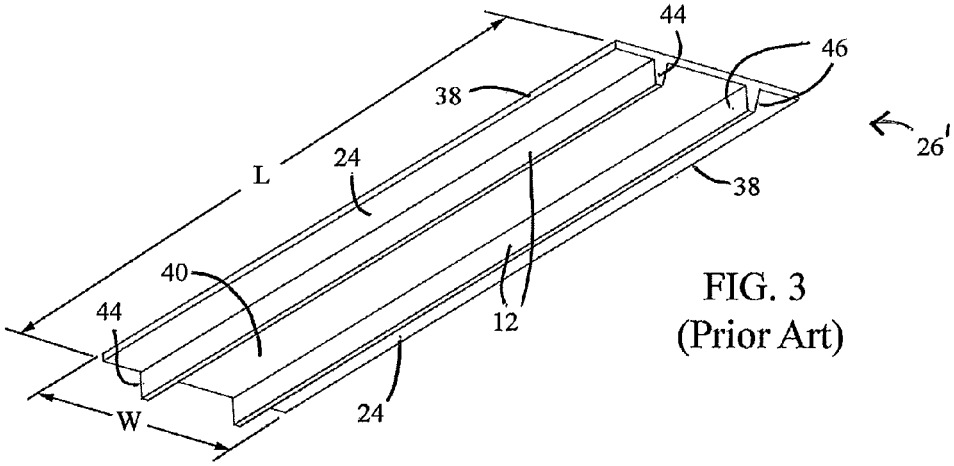
FIG. 3 (Prior Art)
FIG. 3 is a perspective view of a double tee beam.
Figure 4A:
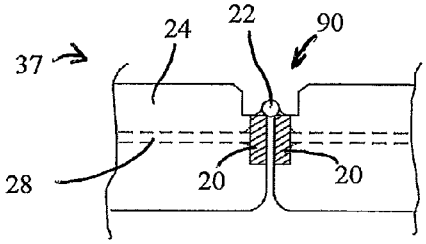
FIG. 4A (Prior Art)
FIG. 4A is a cross sectional end view of a prior art flange connection.
Figure 4B:
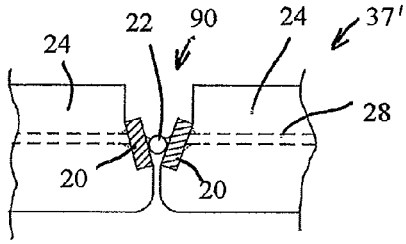
FIG. 4B (Prior Art)
FIG. 4B is a cross sectional end view of a second embodiment of a prior art flange connection.
Figure 4C:
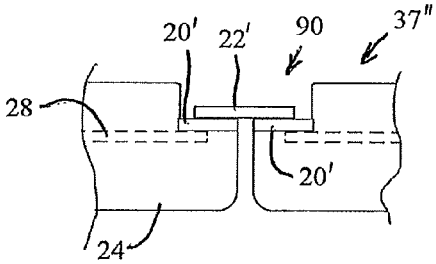
FIG. 4C (Prior Art)
FIG. 4C is a cross sectional end view of a third embodiment of a prior art flange connection.
Figure 4D:
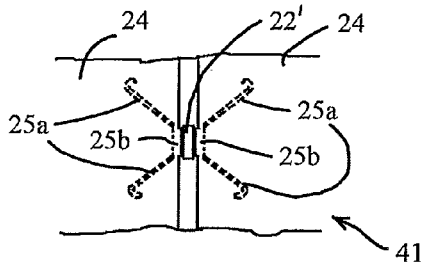
FIG. 4D (Prior Art)
FIG. 4D is a top plan view of a vector connection in a prior art flange connection.
Figure 5:
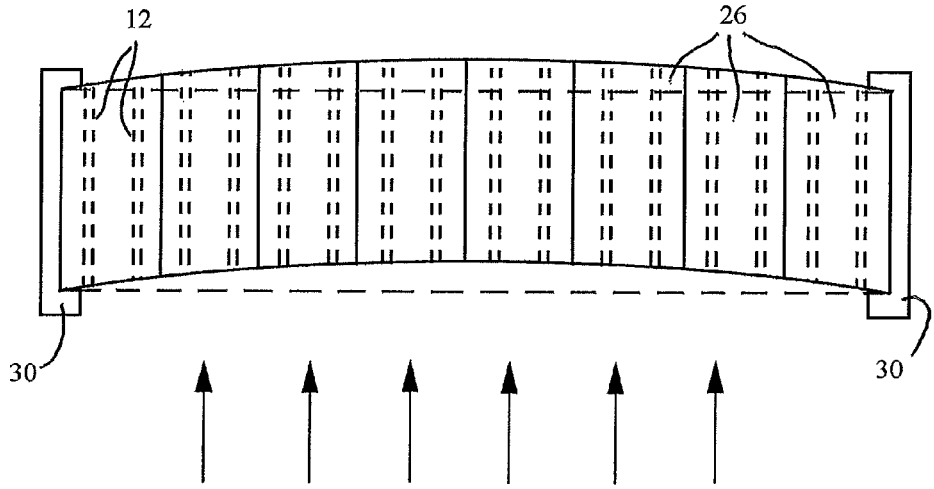
FIG. 5 (Prior Art)
FIG. 5 is a top plan view of a concrete diaphragm having lateral loading from seismic or wind forces.
Figure 6:
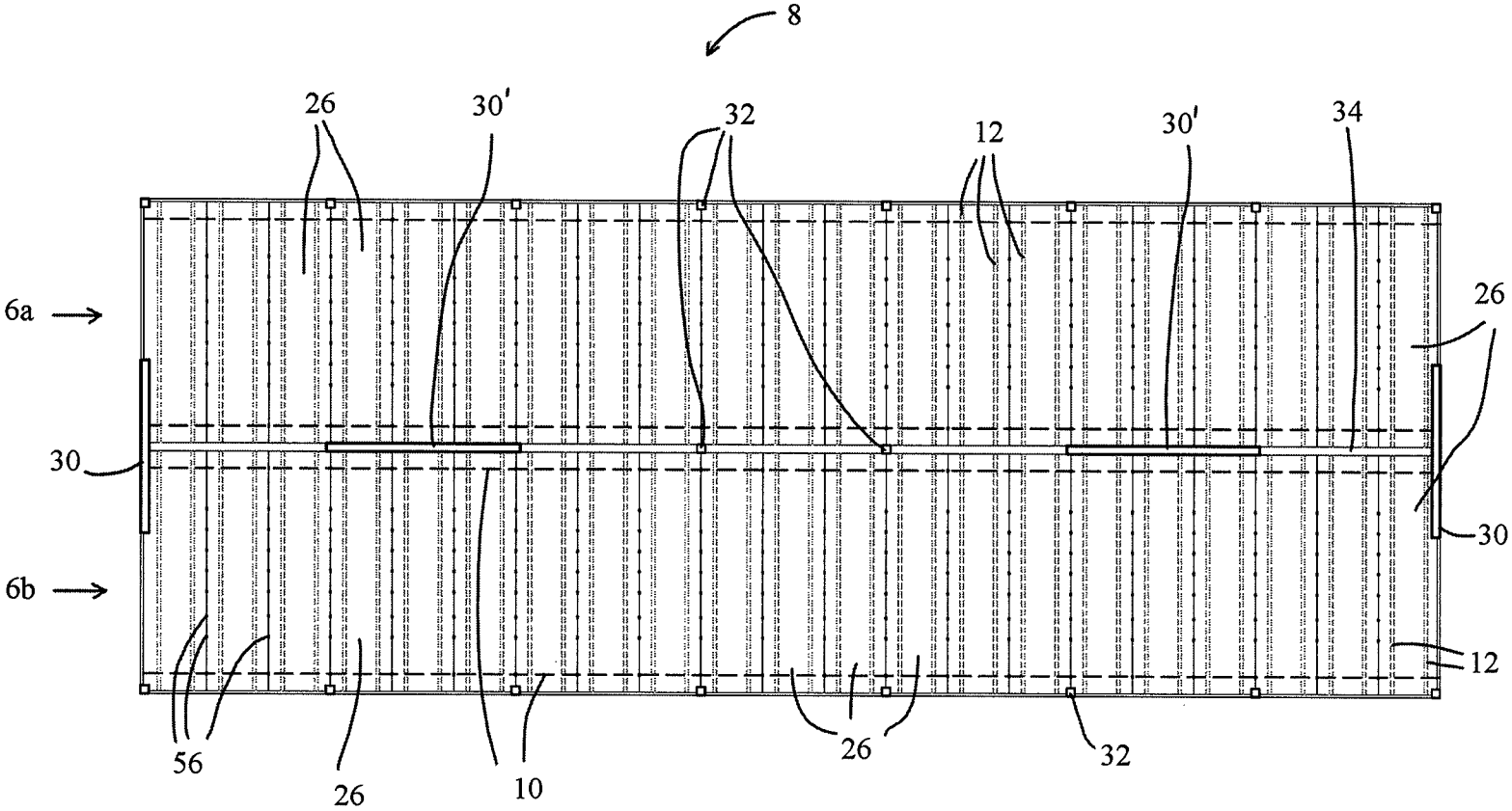
FIG. 6 is a top plan view of a concrete structure according to the present invention.
Figure 16:
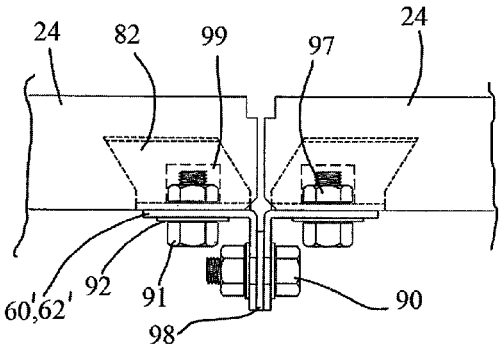
FIG. 16 is a side elevational view of the flexible shear connection shown in FIG. 12.

The concrete structure 8 shown in the top elevational view of FIG. 6 includes flexible shear connections 56 along adjacent flanges 24 of precast concrete members 26. The concrete structure 8 is preferably a parking garage and includes at least one diaphragm 6*a*, 6*b* which comprises a plurality of precast concrete members 26. The diaphragms 6*a*, 6*b* each consist of a row of precast concrete members 26. The concrete structure comprises at least one diaphragm having an array of precast concrete members 26. The diaphragm may include one or more rows of precast concrete members 26 usually terminating with a lateral bracing member 30 at or near the end of each row. Lateral bracing members 30' may be used at other locations below the diaphragm, providing additional lateral stability to the concrete structure 8. The precast concrete member may be a double tee beam 26' as shown in FIG. 3. The center panel 40 and the flanges 24 make up the platform of the double tee beam 26'. The platform is substantially horizontal so that it may provide gravity support for people, motor vehicles or other items. The platform may also have an incline for use in a ramp or a variable incline to promote drainage. The flange 24 includes flange ends 38 substantially parallel to the beam web 12. Lateral bracing members 30 may directly support the diaphragm. Alternatively or in combination, the lateral bracing member support girders 34 which support the concrete member 26 or the diaphragm. Columns 32 may provide support to the concrete structure 8 at specified locations. A chord 10 may be implemented for the control of tension and compression forces.

The precast concrete member may include a center panel and flange ends extending outward from the center panel wherein the entire precast member is substantially flat on both the upper and lower surfaces and the flange ends are an extension of the center panel.

FIGS. 7-11 show a first embodiment of a flexible shear connection 72 used in a flange connection system for a concrete structure. The shear connection 72 includes adjacent flange ends 24 along the length of the precast concrete members, each flange having a bottom surface 25 and flange ends 27. The connection includes bent plates 60 having a horizontal member 62 attached to the bottom surface 25 of the flange 24 and a vertical member 64 perpendicular to the horizontal member 62 of the bent plate 60. The horizontal member 62 includes circular openings 67 and the vertical member 64 includes circular or elongated openings 68. The elongated openings 68 are positioned differently on adjacent vertical members, one vertical member having the elongation in the vertical direction and the adjacent vertical member having the elongation in the horizontal direction as shown in FIG. 7. This positioning of the elongated openings 68 allows for the bent plates 60 to be installed with a positioning tolerance. Alternately, the elongated openings may be omitted and circular openings punched or drilled to custom fit or punched or drilled in place after bent plates 60 are fastened to the flange ends 24. A spacer plate 98 includes spacer plate openings 66 and is disposed between the vertical members 64 of the bent plates 60. The spacer plate extends from about the bottom of the vertical member 64 to just above the elongated openings 68. As shown in FIG. 11, the spacer plate 98 does not extend to the top of the vertical member 64 and has a vertical height less than the height of the vertical member 64 of the bent plate 60 bracket. The vertical distance from the top of the spacer plate 98 to the plane of the horizontal member 62 is sufficient to allow the vertical member 64 to flex or bend along the vertical member portion above the washer plate when there are compression forces between adjacent flanges 24, allowing adjacent flanges 24 to move toward each other. The flexibility of the vertical members 64 helps prevent connection failure from the tension forces. The amount of space above the spacer plate 98 and below the plane of the horizontal member 62 is sufficient to allow flexing of the vertical members along an upper portion above the spacer plate so adjacent flanges 24 may move both toward each other and away from each other. Threaded fasteners 90, threaded nuts 96 and washers 92 secure the vertical members 64 of adjacent bent plates 60 to the spacer plate 98.

The bent plates 60 are attached to the bottom surface 25 of the flange ends 24 by fasteners which include threaded studs 94, nuts 96 and washers 92. The threaded studs 94 are cemented in flange openings 50 with a high strength epoxy or other adhesive.

Figure 17:
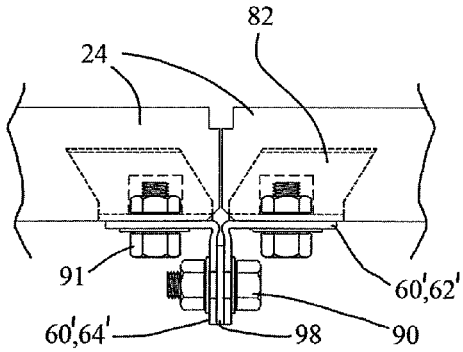
FIG. 17 is a side elevational view of the flexible shear connection shown in FIG. 12 with the flexible shear connection in a flexed position with the flanges in tension.
Figure 18:
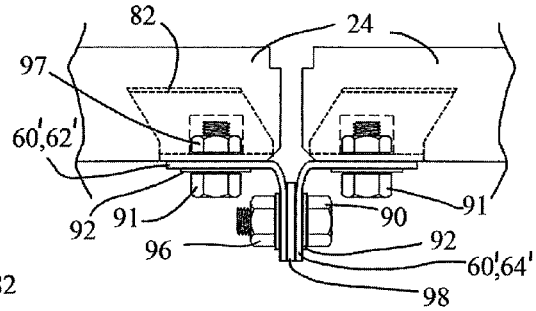
FIG. 18 is a side elevational view of the flexible shear connection shown in FIG. 12 with the flexible shear connection in a second flexed position with the flanges in compression.
Figure 19:
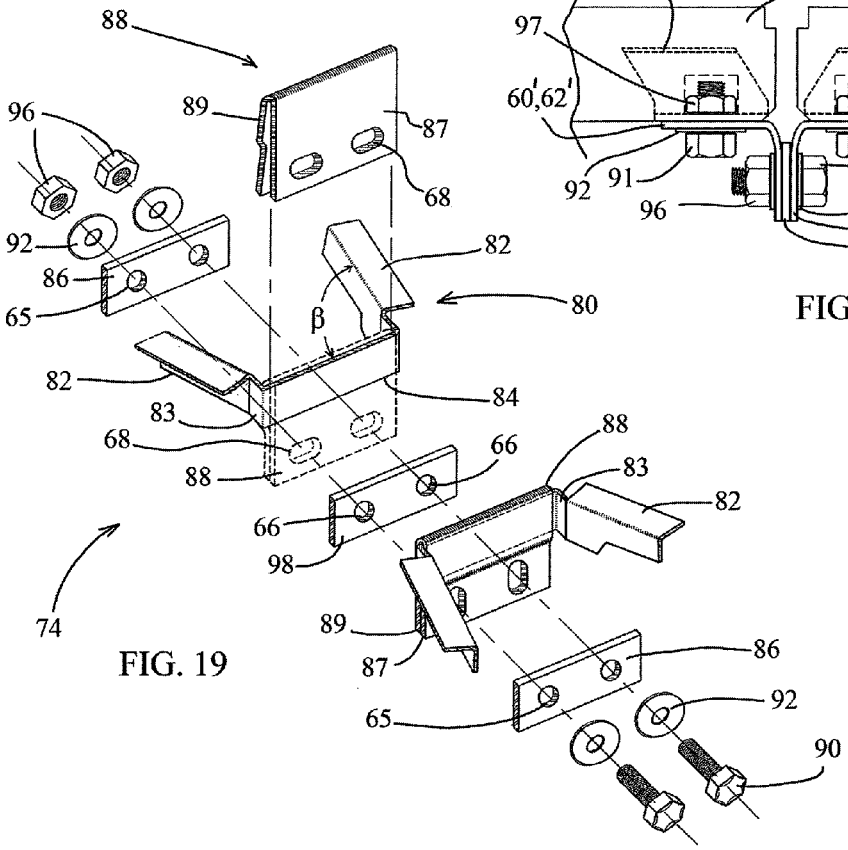
FIG. 19 is a perspective view of a second embodiment of the flexible shear connection according to the present invention.
Figure 20:
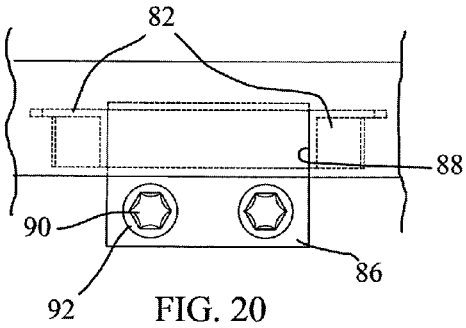
FIG. 20 is a front elevational view of the flexible shear connection shown in FIG. 19.
Figure 21:
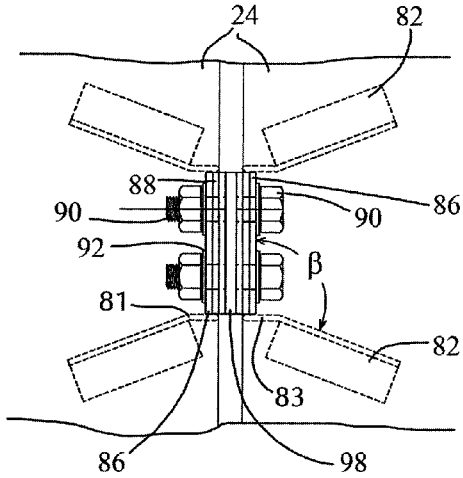
FIG. 21 is a bottom plan view of the flexible shear connection shown in FIG. 19.
Figure 22:
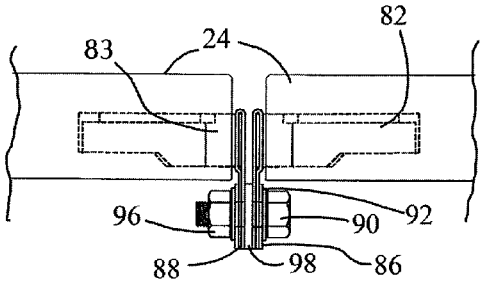
FIG. 22 is a side elevational view of the flexible shear connection shown in FIG. 19.
Figure 23:
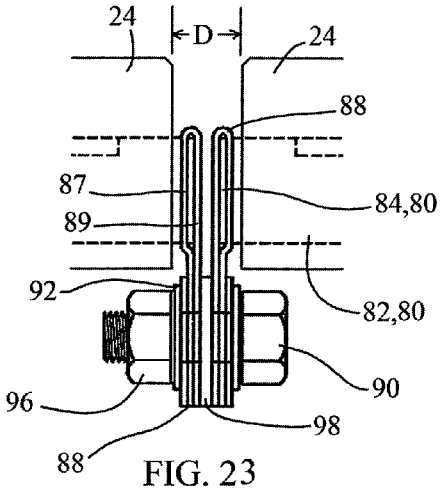
FIG. 23 is an enlarged view of the bent clip shown in FIG. 22.
Figure 24:
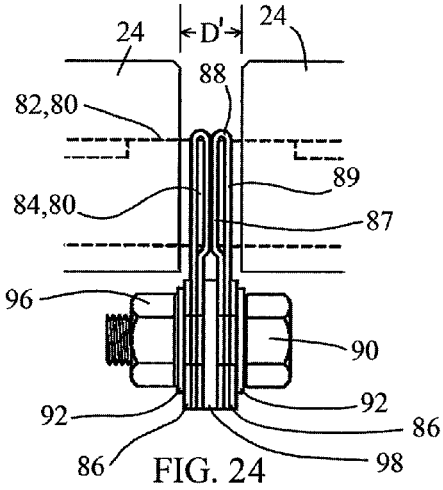
FIG. 24 is an enlarged view of the bent clip used in a reversed position from the position shown in FIG. 22.

FIGS. 12-18 show another embodiment of the flange connection system which includes the bent plates 60' fastened to a connector bracket 52. The horizontal member 62' includes circular or elongated openings 67' and the vertical member 64' includes circular or elongated openings 68'. The elongated openings 67' are positioned differently on adjacent bent plates 60'. This positioning of the elongated openings 67' allows for the bent plates 60' to be installed with a positioning tolerance. The elongated openings 68' are positioned differently on adjacent vertical members, one vertical member having the elongation in the vertical direction and the adjacent vertical member having the elongation in the horizontal direction. This positioning of the elongated openings 68' allows for the bent plates 60' to be installed with a positioning tolerance. Alternatively the elongated openings 68' may be omitted and circular openings punched or drilled to custom fit or punched or drilled in place after bent plates 60' are fastened to the connector brackets 52. The bent plates are removably attachable to the connector bracket 52, 52' with threaded fasteners 91. The connector bracket has an angled portion 54 which is embedded in the concrete flange and a horizontal connector bracket member 53 adjacent to the bottom surface 25 of the flange. The horizontal connector bracket member 53 may be embedded in the bottom surface 25 of the flange or the horizontal connector bracket member 53 may be just below the bottom surface of the flange 24. The connector bracket 52 is embedded into the flange 24 at the time the concrete member is being manufactured. The connector bracket 52 includes female threaded fasteners 97 attached to the horizontal connector bracket member 53 and a cap 99 covering the female threaded fasteners 97 whereby concrete is prevented from contacting the female threaded fasteners 97. The cap 99 has a vertical height sufficient to allow threaded fasteners 91 to fully engage with the female threaded fasteners 97. The threaded fasteners 91 extend through washers 92, bent plate horizontal member 62', horizontal connector bracket member 53 and engage with female threaded fasteners 97. Horizontal connector bracket member 53 includes an angle $\alpha$ which may be any angle between 0° and 180°. FIGS. 12-14 show the angle $\alpha$ at about 90°. The preferable angle $\alpha$ is between 110° and 135° as shown in the obtuse angle in FIG. 15. The obtuse angle helps in preventing the bracket from sliding out horizontally from the flange. Threaded fasteners 90, threaded nuts 96 and washers 92 secure the vertical members 64 of adjacent bent plates 60 to the spacer plate 98. The spacer plate 98 includes circular openings 66 and is disposed between the vertical members 64' of the bent plates 60'. The spacer plate extends from about the bottom of the vertical member 64' to just above the elongated openings 68'. As shown in FIG. 17, the spacer plate 98 does not extend to the top of the vertical member 64 and has a vertical height less than the height of the vertical member 64 of the bent plate 60 bracket. The amount of space above the spacer plate 98 and below the plane of the horizontal member 62 is sufficient to allow flexing of the vertical members along an upper portion above the spacer plate. FIGS. 17 and 18 show the deflection of the vertical member in compression and tension respectively.

Another embodiment of the flange connection system is shown in FIGS. 19-24. A flange connection system for a concrete structure comprises a pair of connector brackets 80 each having connector bracket angled members 82 embedded in adjacent flanges 24 and a connector bracket plate 84 perpendicular to connector bracket angled member 82. Connector bracket 80 includes an angle β which may be any angle between 0° and 180° and is preferably between 110° and 135°. The preferred angle is an obtuse angle and helps in preventing the bracket 80 from sliding out horizontally from the flange. An extension portion 83 is disposed between the bracket angled member and the bracket plate 42 so the angled member lies completely embedded in the flange. The system includes a pair of folded plate clips 88 adapted to engage the connector bracket vertical member 84 and a spacer plate 98 including circular openings 66 is disposed between adjacent folded plate clips 88. The spacer plate extends from about the bottom of the folded plate clips 88 to just above the elongated openings 68. The elongated openings 68 are positioned differently on adjacent folded plate clips 88. This positioning of the elongated openings 68 allows for folded plate clips 88 to be installed with a positioning tolerance. Alternatively the elongated openings may be omitted and circular openings punched or drilled to custom fit or punched or drilled in place after folded plate clips 88 are positioned over vertical member 84. The folded plate clips 88 include elongated openings 68. The folded plate clips include a first half 87 having a flat surface and a second half 89 having a bend, together engagable with the connector bracket vertical member 84. As shown in the enlarged views of FIGS. 23 and 24, the folded plate clips 88 may be flipped so the second half 89 of the clip 88 is facing the adjacent clip. A spacer plate 98 is disposed between adjacent folded plate clips 88. Threaded bolts 90 extends through washer 92, circular washer plate openings 65 in washer plate 86, elongated clip opening 68 in clips 88, spacer plate 98 and engages with female threaded nuts 96. The washers 92 and washer plate 66 may each be used alone or in combination. The spacer plate 98 has a vertical height less than the height of the folded plate clips 88. The amount of space above the spacer plate 98 and below the bottom of member 84 is sufficient to allow flexing of the folded plate clips 88 along an upper portion of the clips 88 above the spacer plate. The washer plate 86 may be used without the washers 92. Alternately, the washers 92 may be used without the washer plate 86.

The threaded bolts 90 are preferably slip-critical bolts when placed in elongated holes. A slip-critical bolt is used to secure a plurality of components having elongated openings in which the bolt extends through. The slip-critical bolt has a high torque capacity so that the compression produced by the bolt in the connection prevents the components from slipping in relation to one another. The elongated holes allow the components to be repositioned when the bolt is loosened.

Another embodiment of the present invention is directed to a method for installing flange connections for precast concrete structures. The method comprises providing a plurality of adjacent precast concrete members which includes a platform having a center panel and a first and second flange extending outward from the center panel in opposing directions. Each flange has a bottom surface and a flange end. The method includes providing a first and second bent plate each having a horizontal member attachable to the bottom surface of the first and second flange respectively and a vertical member perpendicular to the horizontal member, the vertical member having vertical member openings. A spacer plate is provided having spacer plate openings. The spacer plate has a vertical height less than the height of the vertical member of the first and second bracket. The remaining space above the spacer plate and below the plane of the horizontal plate is sufficient to allow flexing of the vertical members 64 along an upper portion above the spacer plate. The method includes providing a plurality of fasteners, ensuring the first flange end is aligned with the second flange end, fastening the first bent plate to the bottom surface of the first flange and fastening the second bent plate to the bottom surface of the second flange. The method includes placing the spacer plate between the first and second connector bracket and aligning the spacer plate openings with the first connector bracket openings and the second connector bracket openings. The method includes placing the fasteners through the openings of the first connector bracket vertical member openings, spacer plate and second connector bracket vertical member openings and tightening the fasteners.

In an alternate embodiment of the method, the step of ensuring the first flange is aligned with the second flange may be performed after fastening the first bent plate to the bottom surface of the first flange and fastening the second bent plate to the bottom surface of the second flange.

In another embodiment of the present invention directed to a method for installing flange connections for precast concrete structures, the method comprises providing a plurality of adjacent precast concrete members which includes a platform having a center panel and a first and second flange extending outward from the center panel in opposing directions. Each flange has a bottom surface and a flange end. The method includes providing a first and second bent plate each having a horizontal member attachable to the bottom surface of the first and second flange respectively and a vertical member perpendicular to the horizontal member, the vertical member having vertical member openings. A spacer plate is provided having spacer plate openings. The spacer plate has a vertical height less than the height of the vertical member of the first and second bracket. The remaining space above the spacer plate and below the plane of the horizontal plate is sufficient to allow flexing of the vertical members 64 along an upper portion above the spacer plate. The method includes providing a plurality of fasteners, ensuring the first flange end is aligned with the second flange end, fastening the first bent plate to the bottom surface of the first flange and fastening the second bent plate to the bottom surface of the second flange. The method includes placing the spacer plate between the first and second connector bracket and aligning the spacer plate openings with the first connector bracket openings and the second connector bracket openings. The method includes placing the fasteners through the openings of the first connector bracket vertical member openings, spacer plate and second connector bracket vertical member openings and tightening the fasteners.

The present invention has been shown to achieve the object of the invention including providing a system for creating, replacing, restoring or reinforcing connections along adjacent flanges of tee/double tee beams. The system also provides a system for efficient low cost creation, replacement, restoration or reinforcement of flange connections in a concrete structure.

The present invention achieves the objectives of providing a system for creating, replacing, restoring or reinforcing connections along adjacent flanges precast concrete members as well as providing a system for creation, replacement, restoration or reinforcement of a shear connection in a concrete structure. The objectives of providing a system for a flexible flange connection in a concrete structure which allows deflection of adjacent precast concrete structures at or near the flexible flange connection and of providing a shear connection which is flexible and prevents stress due to loading have also been achieved. The objective to provide a system for efficient low cost creation, replacement, restoration or reinforcement of flange connections in a concrete structure has been met.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A flange connection system for a concrete structure comprising:

a plurality of adjacent precast concrete members which includes a platform having a center panel and a first and second flange extending outward from the center panel in opposing directions, each flange having a bottom surface and an end, the first flange of one concrete member being disposed adjacent to the second flange of the adjacent precast concrete member;

a first bent plate having a horizontal member attached to the bottom surface of the first flange and a vertical member perpendicular to the horizontal member of the first bent plate;

a second bent plate having a horizontal member attached to the bottom surface of the second flange and a vertical member perpendicular to the horizontal member of the second bent plate;

a spacer plate disposed between the vertical member of the first bent plate and the vertical member of the second bent plate, wherein the spacer plate extends in a vertical direction from about a lower edge of the first bent plate vertical member to a distance below the first bent plate horizontal member allowing the first and second bent plate vertical members to flex at an upper portion of the first and second bent plate vertical members, thereby allowing the first and second flange ends to move toward and away from one another; and a plurality of fasteners securing the vertical member of each of the first and second bent plates to the spacer plate.

2. The system of claim 1 wherein the first bent plate vertical member includes openings elongated in a horizontal direction and the second bent plate vertical member includes openings elongated in the vertical direction.

3. The system of claim 1 wherein the precast concrete member is a tee beam or a double tee beam.

4. The system of claim 1 including a first connector bracket having a portion disposed within the concrete of the first or second flange and an exposed horizontal plate adjacent the bottom surface of the corresponding flange, the horizontal plate including at least one female threaded connector, wherein the horizontal member of the first or second bent plate is fastened to the horizontal plate with at least one male threaded fastener engaged with the at least one female threaded connector.

5. The system of claim 4 including a second connector bracket having a portion disposed within the concrete of the other of the first or second flange.

6. The system of claim 4 wherein the first bent plate vertical member includes openings elongated in a horizontal direction and the second bent plate vertical member includes openings elongated in the vertical direction.

7. The system of claim 4 wherein the precast concrete member is a tee beam or a double tee beam.

8. A method for installing flange connections for precast concrete structures comprising:

providing a plurality of adjacent precast concrete members which includes a platform having a center panel and a first and second flange, each flange having a flange bottom surface and a flange end, the flanges extending outward from the center panel in opposing directions, the first flange end of one concrete member being disposed adjacent to the second flange end of the adjacent precast concrete member;

providing a first and second bent plate, each bent plate having a horizontal member attached to the bottom surface of the first and second flanges respectively and a vertical member perpendicular to the horizontal member, each vertical member having vertical member openings;

providing a spacer plate having spacer plate openings;

providing a plurality of fasteners;

ensuring the first flange is aligned with the second flange;

fastening the first bent plate to the bottom surface of the first flange;

fastening the second bent plate to the bottom surface of the second flange;

placing the spacer plate between the first bent plate vertical member and the second bent plate vertical member with the spacer plate openings aligning with first bent plate vertical member openings and the second bent plate vertical member openings, wherein the spacer plate extends in a vertical direction from about a lower edge of the first bent plate vertical member to a distance below the first bent plate horizontal member allowing the first and second bent plate vertical members to flex at an upper portion of the first and second bent plate vertical members, thereby allowing the first and second flange ends to move toward and away from one another;

placing the fasteners through the openings of the first bent plate vertical member openings, the spacer plate openings and second bent plate vertical member openings; and tightening the fasteners.

9. The method of claim 8 wherein the first bent plate vertical member openings are elongated in a horizontal direction and the second bent plate vertical member openings are elongated in the vertical direction.

10. The method of claim 8 wherein the precast concrete member is a tee beam or a double tee beam.

* * * * *